United States Patent [19]

Peleg et al.

[11] Patent Number: 5,077,455

[45] Date of Patent: Dec. 31, 1991

[54] EASY OPEN MICROWAVE SUSCEPTOR SLEEVE FOR PIZZA AND THE LIKE

[75] Inventors: Yigal Peleg, Solon; Gregory A. Sears, Cuyahoga Falls; David S. Payne, Streetsboro, all of Ohio

[73] Assignee: The Stouffer Corporation, Solon, Ohio

[21] Appl. No.: 565,701

[22] Filed: Aug. 13, 1990

[51] Int. Cl.[5] ..... H05B 6/80

[52] U.S. Cl. ..... 219/10.55 E; 219/10.55 F; 426/107; 426/234; 229/903; 99/DIG. 14

[58] Field of Search ..... 219/10.55 E, 10.55 F; 426/107, 111, 113, 234, 241, 243; 229/903, 126, 127; 99/DIG. 14

[56] References Cited

U.S. PATENT DOCUMENTS

| | | | |
|---|---|---|---|
| 4,190,757 | 2/1980 | Turpin et al. | 219/10.55 E |
| 4,228,945 | 10/1980 | Wysocki | 219/10.55 E X |
| 4,585,915 | 4/1986 | Moore | 219/10.55 E |
| 4,626,641 | 12/1986 | Brown | 219/10.55 E |
| 4,641,005 | 2/1987 | Seiferth | 219/10.55 E |
| 4,703,148 | 10/1987 | Mikulski et al. | 219/10.55 E |
| 4,780,587 | 10/1988 | Brown | 219/10.55 E |
| 4,794,005 | 12/1988 | Swiontek | 426/107 |
| 4,882,463 | 11/1989 | Kyougoku et al. | 219/10.55 E |
| 4,891,482 | 1/1990 | Jaeger et al. | 219/10.55 E |
| 4,965,424 | 10/1990 | Bagley | 219/10.55 E |

*Primary Examiner*—Philip H. Leung

*Attorney, Agent, or Firm*—Body, Vickers & Daniels

[57] ABSTRACT

An improved sleeve receptacle for microwave browning and crisping of a generally flat food article, such as pizza, in a microwave oven is provided. The receptacle is constructed from a sheet of microwave susceptor stock which preferably includes an outwardly exposed dielectric support layer and an inwardly facing heating layer of microwave interactive material allowing passage of microwave energy as it is heated thereby. The sleeve is initially provided as a flat sheet which can be easily fitted within the frozen food package. The consumer folds the flat sheet into its sleeve configuration by joining the top portions of the sleeve together in a manner whereby the top portions of the sleeve can be later pulled apart to permit easy removal of the heated foodstuff.

11 Claims, 3 Drawing Sheets

FIG. 5
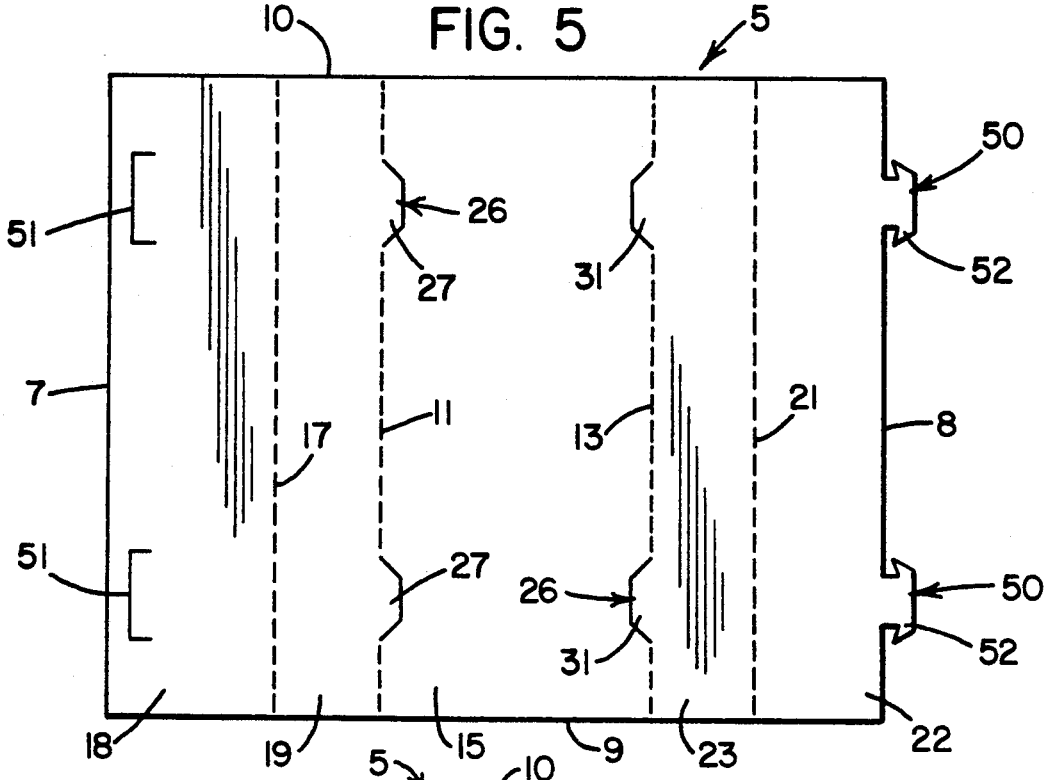
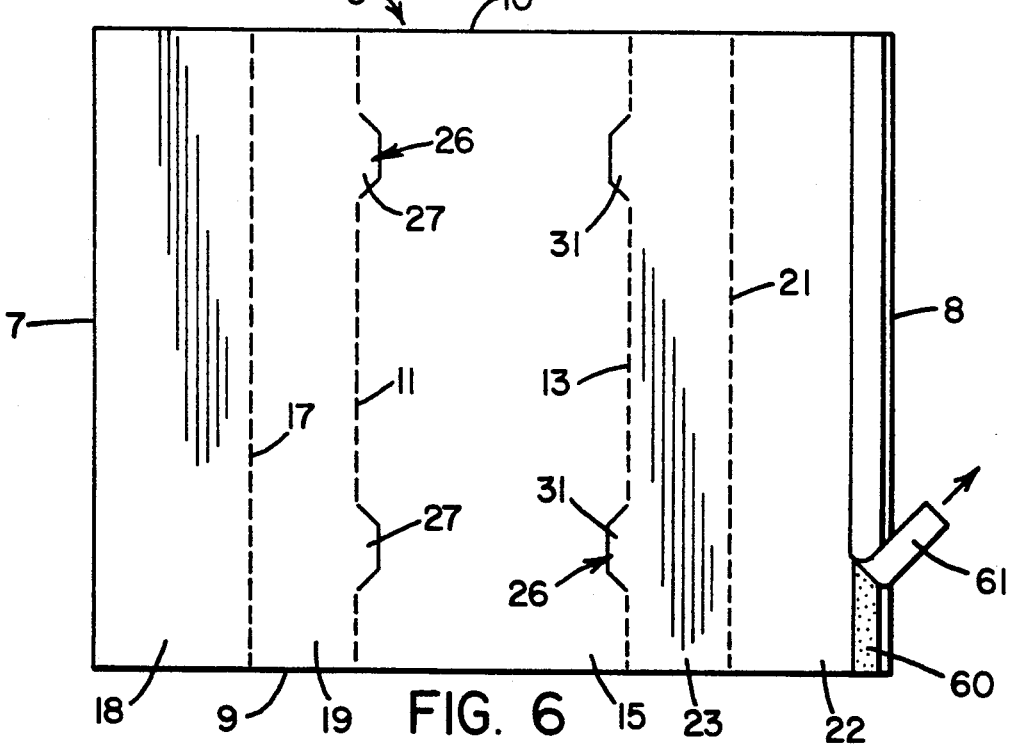
FIG. 6
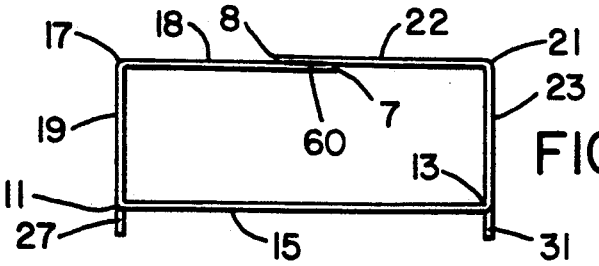
FIG. 7

EASY OPEN MICROWAVE SUSCEPTOR SLEEVE FOR PIZZA AND THE LIKE

This invention relates to the art of microwave heating food products and more particularly to a microwave heating receptacle formed from susceptor sheet stock.

INCORPORATION BY REFERENCE

For the purpose of background information, the following United States patents are incorporated by reference herein and made a part hereof: Turpin U.S. Pat. No. 4,190,757; Brown U.S. Pat. No. 4,626,641 and 4,780,587; Seiferth U.S. Pat. No. 4,641,005; Swiontek U.S. Pat. No. 4,794,005; and Jaeger et al U.S. Pat. No. 4,891,482. These patents constitute a portion of the patented prior art and are incorporated to define the background of the present invention so that details known in the art need not be repeated to understand the present invention or appreciate its novelty and substantial contribution to the field of low cost packaging for microwave heating.

BACKGROUND OF THE INVENTION

When cooking frozen foods and the like in a microwave oven, it is desired to heat the foodstuff not only from penetration of microwave energy but also by convection and conduction from the receptacle on which the food article is positioned. An early concept, suggested by Turpin U.S. Pat. No. 4,190,757 was to use a composite material which contained a lossy substance which permitted a portion of the microwave energy to pass through the material for heating the foodstuffs by microwave absorption while also being heated by the microwave energy so that the support material itself could additionally heat the food. This concept was further refined in Seiferth U.S. Pat. No. 4,641,005 which produced Turpin's lossy material by vacuum depositing a very thin film of microwave interactive metal having a surface sensitivity expressed in ohms per inch onto a plastic film which in turn was bonded to an article support surface. When it was found that the support surface for Seiferth's tape could comprise paperboard, typically 16 point paperboard with a rigidity of standard posterboard stock, widescale commercial use of the susceptor sheet stock to form plates, boats and platforms for reconstitution of frozen food in microwave ovens resulted. This invention uses conventional susceptor sheet stock which is defined as a generally continuous, microwave interactive material formed by vacuum depositing a thin layer of aluminum or similar microwave interactive metal onto a smooth plastic support film as taught by Seiferth which in turn is adhered to a flat of generally rigid paperboard.

It has been found that certain frozen foods, such as pizza pies, when reconstituted in a microwave oven, required specially formed susceptor sheet stock receptacles which could heat the crust. Examples of susceptor sheet stock sleeves supplied within the food package are disclosed in Brown U.S. Pat. No. 4,780,587 and Swiontek U.S. Pat. No. 4,794,005. Both Brown '587 and Swiontek have certain package characteristics similar to that of the invention disclosed herein, but Brown and Swiontek receptacles are preformed. Brown U.S. Pat. No. 4,626,641 illustratrates a consumer formed container having portions of microwave susceptor sheet stock. Jaegar U.S. Pat. No. 4,891,482, owned by the assignee of this invention, particularly advanced the art by developing a pop-up sleeve formed of susceptor sheet stock which fit within the frozen food package in a folded position. When the package was opened, the consumer simply removed the sleeve, popped it to its open position and inserted the sleeve with the pizza therein into the microwave oven for cooking. While the sleeve functioned acceptably to heat the pizza and other food crusted materials, there were some disadvantages to the sleeve from a manufacturing and packaging point of view. With respect to the pop-up sleeve embodiment in Jaeger, the edges of the sleeve had to be glued to form a collapsible container increasing material and assembly costs and when the sleeve was collapsed into its initial position, the sleeve took up more space within the carton than otherwise desired. Also, after the pizza was heated within the sleeve, it became difficult to remove the pizza from the sleeve necessitating, in some instances, the consumer cutting the sleeve. It is to be recognized that in order for the microwave susceptor sheet stock to efficiently perform the desired heating, close spaces between the foodstuff and container are required and removal of the heated food can present difficulty to the consumer who attempts to remove a hot item with his or her bare hands. These problems were recognized somewhat in Jaeger and overcome to some extent by an alternative embodiment which used tabs to form a box from a flat sheet of susceptor stock thus obviating the glue step required in the sleeve. However, the box had closed ends when assembled thus preventing air flow and convection heating therethrough which can be achieved with the sleeve. Also, the tabs were unwieldy and it was somewhat difficult to form the box from its flat condition. In addition, a separate spacer sheet had to be provided. Finally, the tab and end wall configuration materially protruded from the body portion of the box in the flat condition. Because the box is cut from a larger sheet of susceptor sheet stock or paperboard, this increases the material usage over that otherwise possible and also adversely dictates the final carton dimensions.

SUMMARY OF THE INVENTION

Accordingly, it is a principal object of the invention to provide a sleeve from susceptor sheet stock for heating frozen food in a microwave oven which is initially supplied in the food package as a single flat sheet that can be easily formed into and out of its sleeve configuration.

This object, along with other features of the invention, is achieved in an open-ended receptacle or sleeve for receiving a frozen food article to be heated in a microwave oven and which is assembled from a flat sheet of susceptor sheet stock defining an initial configuration of said receptacle which is then formed by the consumer into its assembled sleeve configuration. The sleeve, in its initial flat configuration has a rectilinear configuration defined by a pair of generally parallel longitudinally extending edges and a pair of generally parallel laterally extending edges orthogonal to the longitudinal edges and defining the open ends of the receptacle in its sleeve configuration. First and second longitudinally extending fold lines define a base portion of the sleeve which extends therebetween. A third longitudinally extending fold line laterally spaced between one of the longitudinal edges and the first fold line defines a first sidewall portion of the sleeve extending between the first and third fold lines and a first top portion extending between the longitudinal edge and the third fold line. A fourth fold line laterally spaced between the second fold line and the other longitudinal edge defines a second sidewall portion of the sleeve extending between the second and fourth fold lines and a second top portion extending between the other longitudinal edge and the fourth fold line.

In accordance with another aspect of the invention, the sleeve is cut on a leg cut line extending laterally into the base portion from the first fold line for a discrete longitudinal distance to define at least one first leg portion. The sleeve is also cut on a leg cut line extending laterally into the base portion from the second fold line for a discrete longitudinal distance to define at least one second leg portion. When the sleeve is formed by bending the stock about the fold lines, the leg portions extend downwardly from the side wall portions below the base portion to support the base portion above the oven floor. Attachment means associated with one of the longitudinal edges is provided for releasably securing the first top portion of the sleeve with the second top portion of the sleeve when the sheet stock is folded on the fold lines to form the receptacle into its sleeve configuration to permit the first and second top portions to separate for easy removal of the food article after heating.

In accordance with an important aspect of the invention, the attachment means includes a fold line extending diagonally between adjacent longitudinal and lateral edges in the corners of one of the top portions. A first tab cut line extends from the longitudinal edge to the diagonal fold line and a second tab cut line extends from the lateral edge to the diagonal fold line to define an interlocking, bendable tab extending between the tab cut lines which is bent over and overlaps the opposite top portion of the sleeve to interlock one sleeve top portion to the other. In this manner, the susceptor sheet stock is assembled easily into the sleeve configuration and can be easily disassembled after heating for easy removal of the food in a hot condition. Importantly, by forming the tabs as part of the rectilinear configuration of the susceptor sheet stock, susceptor sheet stock savings can be had. Additionally, an adhesive can be applied to the tabs with a protective tear away strip. Alternatively, the attachment means can include an adhesive strip along the length of one of the longitudinal edges for attachment to the underside surface of the opposite top portion. Still further, the attachment means can include laterally extending tabs extending from one of the longitudinal edges and matching slits cut in the susceptor sheet stock between the opposite longitudinal edge and its nearest fold line, the tabs being insertable into these slits to form the sleeve and pullable out of the slits to separate the top portions after heating for easy food removal.

In accordance with other aspects of the invention, a second microwave interactive material layer can be applied to certain portions of the sleeve to promote browning of the foodstuff. That is, a tape containing a thin metal, microwave interactive coating applied by vacuum deposition can be adhesively secured to the external surface of the base portion of the sleeve which in combination with the interactive material on the opposite side of the susceptor sheet stock which forms the interior of the sleeve will act to further promote heating of the paperboard to promote crisping of the bread or browning of food in contact therewith. Still further, a microwave opaque material, such as a thin sheet of aluminum foil, can be adhesively applied to portion(s) of one of the surfaces for browning and crisping. Still further, the flat initial configuration can be formed solely from paperboard and the microwave interactive layer applied only to select portions of the sleeve such as the base portion.

Accordingly, it is an object of the invention to provide a sleeve receptacle for heating a frozen food article such as pizza in a microwave oven, which receptacle is assembled from a flat sheet of susceptor sheet stock so as to take up less carton space.

Another object is the provision of a sleeve receptacle for heating a frozen food article such as pizza in a microwave oven which can be easily assembled by the consumer and which can be easily opened for removal of the foodstuff therein in a hot condition.

Still another object of the invention is to provide a sleeve receptacle for heating food in a microwave oven which can be cut from a large sheet of susceptor sheet stock in a pattern which minimizes any waste of the sheet stock.

These and other objects and advantages will become apparent from the following description taken together with the accompanying drawings described in the next section.

BRIEF DESCRIPTION OF THE DRAWINGS

FIG. 5 is a top view of an alternative embodiment of the sleeve in its initial, flat configuration;

FIG. 6 is a top view of another alternative embodiment of the sleeve in its initial, flat configuration; and FIG. 7 is an end view of the alternative embodiment shown in FIG. 6.

PREFERRED EMBODIMENT

Figure 1:
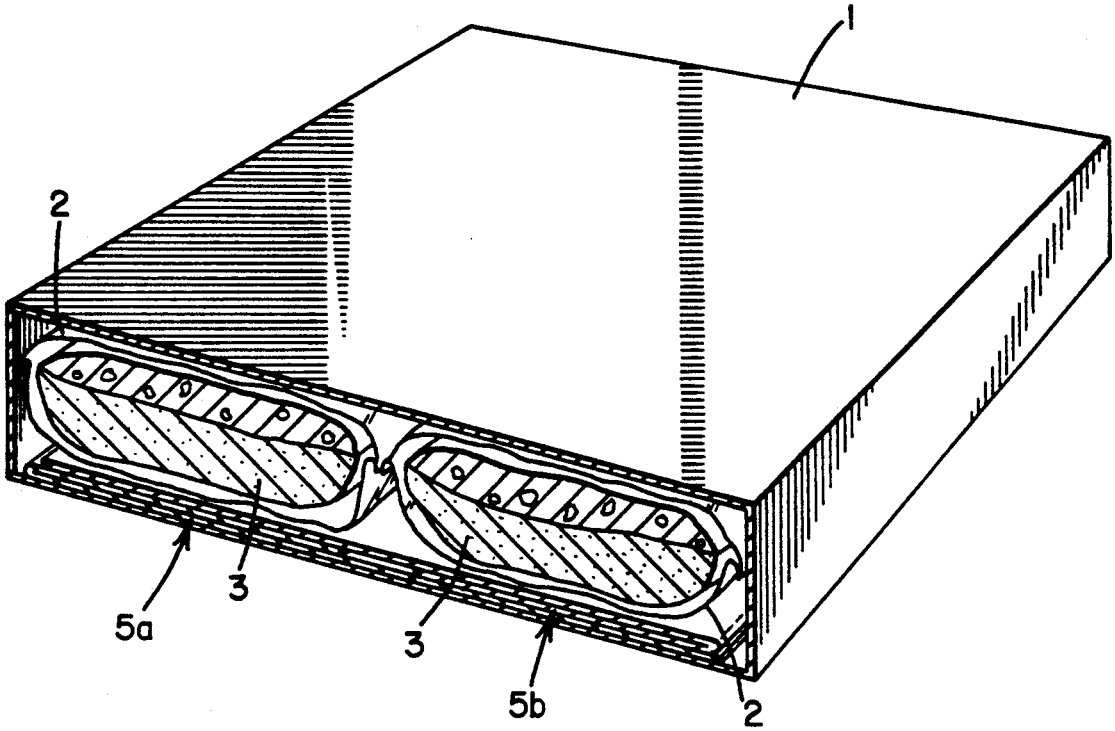
FIG. 1 is a partially cross-sectioned, pictorial view of two packaged pizza segments containing two receptacles constructed in accordance with the preferred embodiment of the present invention.
Figure 2:
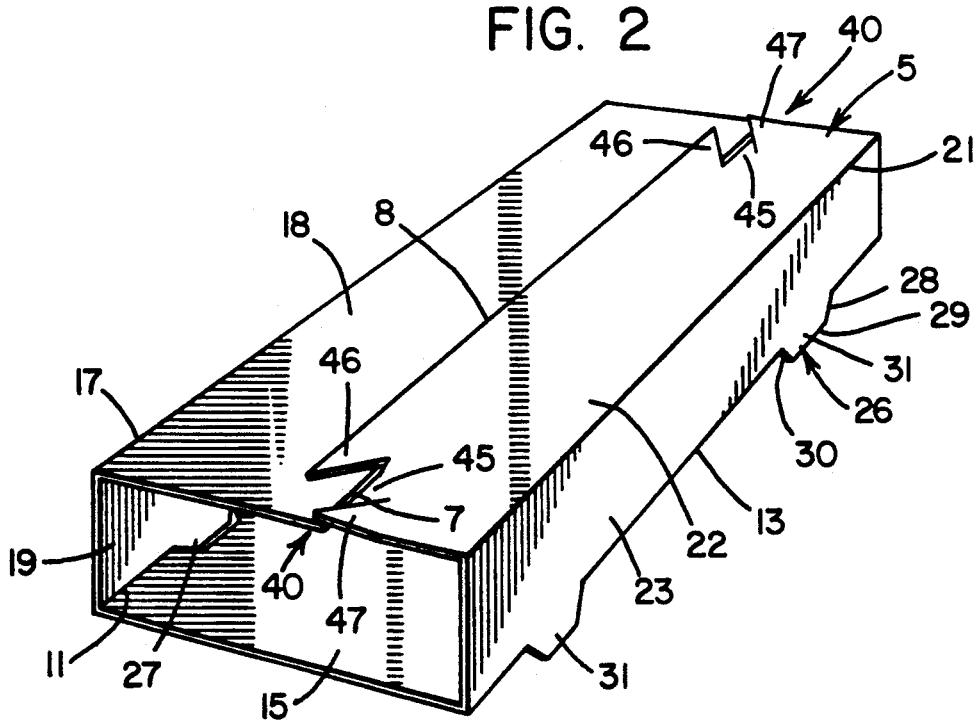
FIG. 2 is a pictorial view of the preferred embodiment of the present invention in its sleeve configuration.
Figure 3:
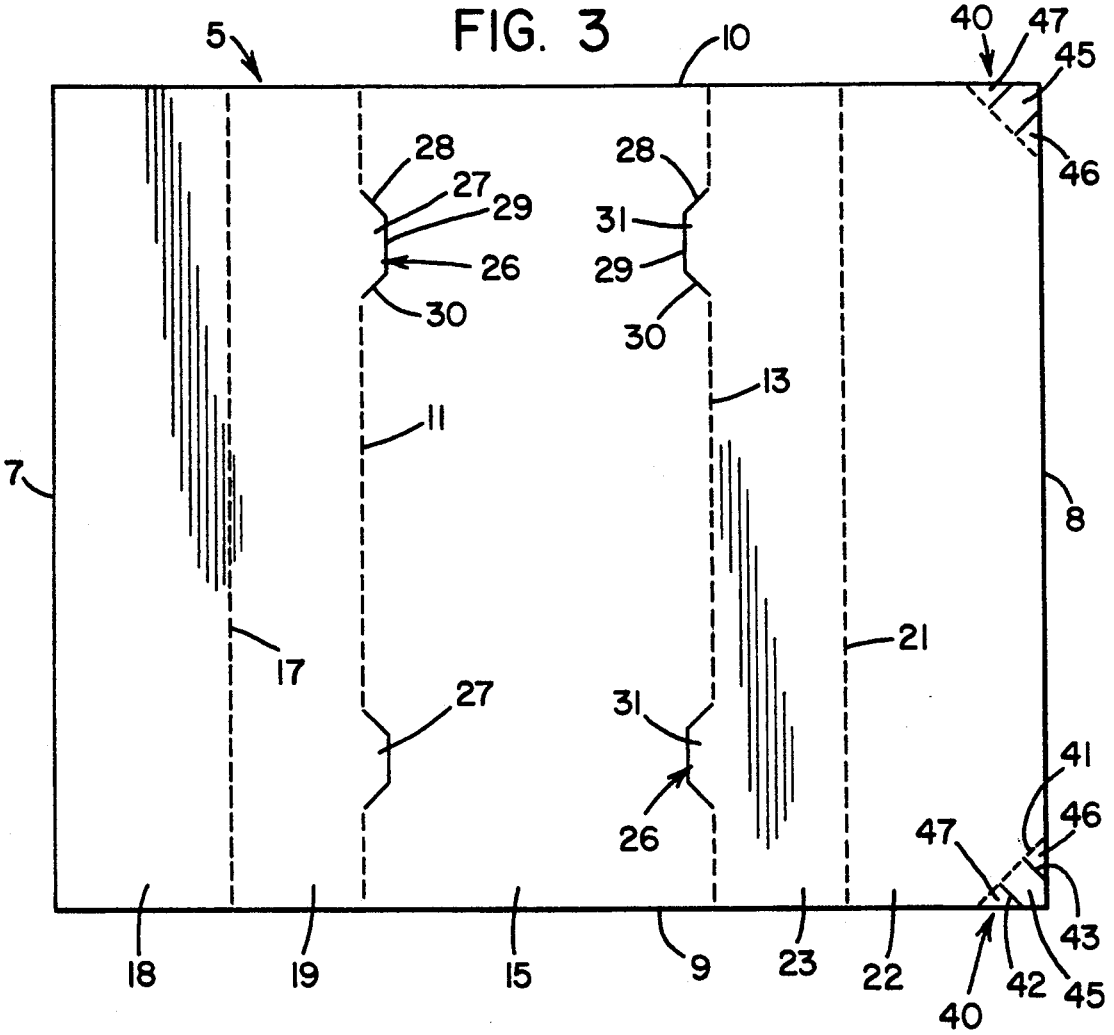
FIG. 3 is a top view of the preferred embodiment of the present invention in its initial, flat configuration as shown in FIG. 1.

Referring now to the drawings wherein the showings are for the purpose of illustrating a preferred and alternative embodiments of the invention only and not for the purpose of limiting the invention, FIG. 1 shows a shipping container 1 containing two French bread pizza pieces 3 in plastic wrappers 2. Shipping container 1 also contains two heating receptacles or sleeves 5 individually indicated by numerals 5*a*, 5*b* located underneath pizza pieces 3. Heating receptacles or sleeves 5 are shipped as flat sheets of susceptor sheet stock which are in the particular configuration as shown in FIG. 3 and defined in detail below. The flat sheets are then formed by the consumer into the sleeve shape as shown in FIG. 2. For definitional purposes, the initial configuration of sleeve 5 means its flat, shipping configuration shape shown in FIGS. 1 and 3 while the assembled configuration of sleeve 5 means its final, sleeve-like shape as shown in FIG. 2. In the heating concept used by the present invention, the consumer assembles the sleeve into its FIG. 2 shape, removes pizza 3 from its plastic wrap 2 and places pizza 3 into sleeve 5 and into a microwave oven for heating. Preferably, pizza and other foodstuffs having a crust are heated in this manner for reasons well known in the prior art. After heating, the consumer opens up the sleeve and removes pizza 3 in its heated state.

The preferred embodiment disclosed in FIGS. 1 through 4 uses microwave susceptor sheet stock material which can be purchased from James River Corporation of Richmond, Va. and has 16 point board with 13-16 ohms/inch. As discussed above, a thin layer of microwave interactive metal such as aluminum is vacuum deposited on tape adhesively secured to one side of the paperboard. In the preferred embodiment, the tape is secured to that side of the paperboard which forms the interior of the package. In the drawings, the tape with the metal deposited thereon is not shown for ease of illustration. It is to be understood that the flat configuration shown in FIG. 3 can be formed from paperboard with tape containing the microwave interactive material applied after the board is cut or the board with the tape containing the microwave interactive material applied thereto can be cut into the FIG. 3 configuration.

In FIG. 3, the configuration of sleeve heating receptacle 5 in its initial or flat position is shown. It is to be understood that sleeve 5 may be cut from a larger sheet (not shown) of susceptor sheet stock and in order that all the material in the larger sheet be efficiently used, the external edge shape of sleeve heating receptacle 5 is important. Sleeve 5 has a rectilinear configuration defined by a pair of generally parallel longitudinally extending edges 7 and 8 and a pair of generally parallel laterally extending edges 9, 10 orthogonal to longitudinal edges 7 and 8. Lateral edges 9, 10 define the open ends of heating receptacle 5 in its assembled sleeve configuration. Within the rectilinear configuration defined by longitudinal edges 7, 8 and lateral edges 9, 10 are fold lines and cut lines. Cut lines are defined herein to mean slits that extend through the susceptor sheet stock material for a predetermined distance. (Longitudinal edges 7, 8 and lateral edges 9, 10 are cut lines.) Fold lines can be indentations made into the paperboard which permit the stock when flexed to bend or be folded thereabout. In the preferred embodiment, fold lines, however, are actually slits or perforations which are approximately 0.03" wide and 0.13" long with a spacing of 0.09". The use of perforations for fold lines assures that sleeve 5 will bend about fold lines.

In the preferred embodiment, there are four longitudinally extending fold lines which extend the length of sleeve 5 and are generally parallel with one another and with longitudinal edges 7, 8. A first longitudinally extending fold line 11 and a second longitudinally extending fold line 13 define a base portion 15 of sleeve 5 which extends therebetween. A third longitudinally extending fold line 17 is laterally spaced between longitudinally extending edge 7 and first fold line 11 to define a first sidewall portion 19 of sleeve 5 which extends between first and third fold lines 11, 17 and a first top portion 18 which extends between longitudinal edge 7 and third fold line 17. A fourth fold line 21 is laterally spaced between second fold line 13 and longitudinal edge 8 to define a second sidewall portion 23 of sleeve 5 extending between second and fourth fold lines 13, 21 and a second top portion 22 extending between longitudinal edge 8 and fourth fold line 21.

Figure 4:
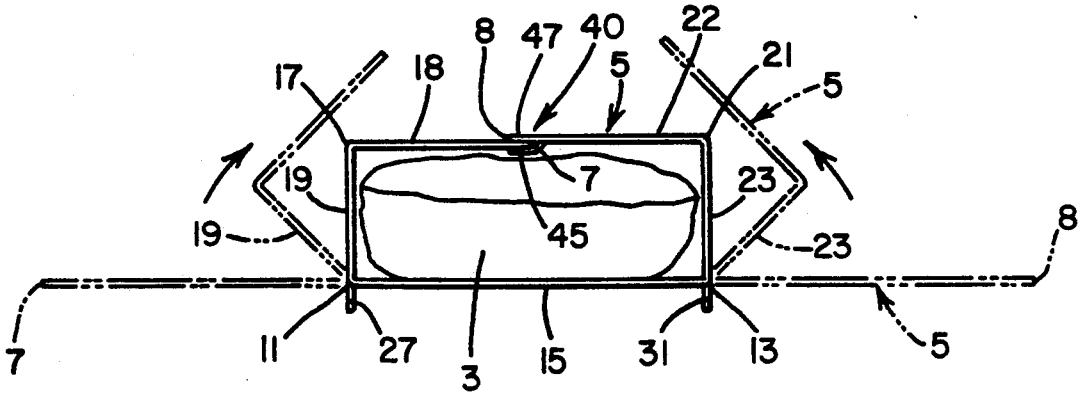
FIG. 4 is an end view of the sleeve receptacle showing how the sleeve is bent into its assembled form with its prior positions shown in dot-dash lines.

A leg cut line 26 extends from first fold line 11 laterally into base portion 15 for a discrete, longitudinally extending distance and then merges back into first fold line 11 to define a first leg portion 27. More specifically, cut line 26 has a leading cut line segment 28 extending at 45° from first fold line 11, a longitudinal cut line segment 29 extending from leading segment 28 and a trailing cut line segment 30 extending from longitudinal segment 29 to first fold line 11. First fold line 11 is discontinuous over the length of cut line segment 26. Other leg cut line configurations will suggest themselves to those skilled in the art and a plurality of first leg portions 27 extending from first fold line 11 are provided, there being two first leg portions shown in FIG. 3. Similarly, a leg cut line 26 extends from second fold line 13 laterally into base portion 15 for a discrete longitudinal distance over which second fold line 13 is discontinuous to define a second leg portion 31, there being two such second leg portions 31 illustrated in the preferred embodiment. With reference to FIG. 4, it can be seen that when sleeve 5 is bent about first and second fold lines 11, 13, first and second leg portions 28, 31 will remain integral with sidewall portions 19, 23 and when sidewall portion 19, 23 are upright, first and second leg portions 28, 31 will support base portion 15 away from the floor of the microwave oven. Within the space between base portion 15 and the floor of the microwave oven created by first and second leg portions 27, 31, oven air can flow for heat transfer convection with base portion 15.

A connector arrangement is used for joining first top portion 18 with second top portion 22 to form sleeve 5 into its assembled configuration. In the preferred embodiment of FIG. 3, the connecting means takes the form of two identical interlocking tabs 40 situated at the corners of one of the top portions which is the preferred embodiment is second top portion 22. Since tabs 40 are identical, only the bottom tab will be explained. Tab 40 is formed by a tab fold line 41 extending diagonally from longitudinal edge 9 to lateral edge 8. A first tab cut line 42 extends from longitudinal edge 9 to tab fold line 41 and a second tab cut line 43 extends from lateral edge 8 to tab fold line 41. In between first and second tab cut lines 42, 43 is a biasing tab portion 45 bendable about tab fold line 41. Biasing tab portion 45 is flanked on each side by smaller triangular wedge portions 46, 47. As best shown in FIG. 4, when sleeve 5 is assembled, lateral edge 7 of first top portion 18 slides underneath (or on top of) second top portion 22 until lateral edge 7 is wedged against tab fold line 41 with biasing tab portion 45 underneath first top portion 18 (or alternatively on top thereof) and wedge tab portions 46, 47 on top of first top portion 18 (or alternatively underneath if tab biasing portion 45 is on top). Lateral edge 7 is essentially wedged between tab biasing portion 45 and wedge portions 46, 47 and sleeve 5 maintains its assembled shape sufficient to permit pizza 3 to be inserted therein and sleeve 5 with pizza 3 to be placed into a microwave oven and cooked. Importantly, after cooking and with sleeve 5 and pizza 3 hot, it is possible to separate top portion 18, 19 without excessive effort on the part of the consumer for pizza removal without burning the hands of the consumer. Further, by forming tabs 40 into the corners of sleeve 5, wasted susceptor sheet stock does not occur. Optionally, it is possible to provide slits or cut lines in first top portion 18 to receive biasing tab portion 45 which could be further modified to have a barbed "arrowhead" configuration, but this is not believed necessary. A further alternative is to provide biasing tab portion 45 with an adhesive to which a protective paper coating is removed when sleeve 5 is to be folded into its sleeve configuration.

A modification is disclosed in FIG. 5 based somewhat on the optional modifications discussed with reference to FIG. 3. In FIG. 5, the same general configuration of sleeve 5 discussed with respect to FIG. 3 is employed and like reference numerals will designate like components of sleeve 5. However, in FIG. 5, the interlocking tabs 40 are replaced with a pair of snap tabs 50 which extend from longitudinal edge 8 and which fit within cut line slits 51 formed in first top portion 18. Snap tabs 50 have head portions 52 shaped like truncated arrowhead barbs and slits 51 are sized slightly less in dimension so that the base of the barb cannot pull back through slit 51. This modification results in a slight waste of susceptor sheet stock material, but the slit and tab dimension is set so that only a slight tug is required to open the sleeve to gain access to the pizza.

A still further modification permitting easy assembly and disassembly of sleeve 5 is shown in FIGS. 6 and 7. Again, the same general configuration of sleeve 5 shown in FIG. 3 is used in FIGS. 6 and 7 and the same reference numerals used in FIG. 3 will designate the same sleeve components shown in FIGS. 6 and 7 where applicable. In FIG. 6, one of the sides of one of the top portions 18, 22 (second portion 22 is illustrated) is coated with a longitudinally extending, thin strip of adhesive 60 adjacent longitudinal edge 8. A paper or plastic film covering 61 is applied over adhesive 60 in the initial, flat configuration of sleeve 5. When the consumer forms sleeve 5 into its assembled shape, covering 61 is removed and the underside of one top portion 22 is temporarily glued to the top side of the other top portion 18. The adhesive is chosen to permit sleeve 5 to be formed into its assembled shape and to retain that shape, but which will still permit the sleeve to be opened for removal of the foodstuff therein without having to resort to scissors or knives or the like.

The invention has been described with reference to preferred and alternative embodiments. Obviously, modifications and alterations will occur to others skilled in the art upon reading and understanding the invention described herein. Specifically, the invention has been thus far described as simply being formed from a microwave susceptor sheet stock. It is known in the art to provide additional layers of microwave interactive materials to the dielectric support surface for enhanced browning or crisping. For example, base portion 15 of sleeve 5 could have a microwave interactive layer applied to its exterior surface as well as the interior surface or more than one layer of microwave interactive material could be applied to the same surface. This would not present any difficulty in manufacturing the sleeve since after the sleeve has been formed in its initial configuration (or even prior to forming), adhesive coated tape with the microwave interactive material could be simply applied over the desired sleeve portion. Still further, if a microwave opaque or reflective portion of the sleeve was desired, say for browning meats, a thin sheet of foil could be similarly applied by adhesive to that portion of the sleeve which was desired to be made opaque to microwave penetration. It is intended to include all such modifications and alterations insofar as they come within the scope of the invention.

Having thus defined the invention, it is claimed:

1. An open ended sleeve receptacle for receiving a frozen food article to be heated in a microwave oven and which is assembled, from a flat sheet of microwave susceptor sheet stock which defines its initial configuration, by the consumer into its assembled sleeve configuration; said sleeve receptacle comprising:

an initially flat sheet of microwave susceptor sheet stock having a rectilinear configuration defined by a pair of generally parallel longitudinally extending edges and a pair of generally parallel laterally extending edges orthogonal to said longitudinal edges and defining the open ends of said receptacle in its sleeve configuration; first and second longitudinally extending fold lines defining a base portion of said sleeve therebetween; a third longitudinally extending fold line laterally spaced between one of said longitudinal edges and said first fold line to define a first sidewall portion of said sleeve extending between said first and third fold lines and a first top portion of said sleeve extending between said third fold line and said one of said longitudinal edges; a fourth fold line laterally spaced between said second fold line and the other longitudinal edge to define a second sidewall portion of said sleeve extending between said second and fourth fold lines and a second top portion of said sleeve extending between said fourth fold line and said other one of said longitudinal edges; and attachment means associated with one of said longitudinal edges for releasably securing said first and second top portions together to form said sleeve configuration for heating said food article while permitting said first and second top portions to be separated after heating for food removal, said sleeve cut on cut lines extending laterally into said base portion from interruptions in said first fold line for a discrete distance and connected by cut lines in said base portion parallel to said first fold line to define two first leg portions extending from said first sidewall portion, and said sleeve having cut lines extending laterally into said base portion from interruptions in said second fold line for a discrete distance and connected by cut lines in said base portion parallel to said second fold line to define two second leg portions extending from said second sidewall portion whereby said leg portions underlie said sidewall portions and support said base portion spaced away from the floor of said oven.

2. The receptacle of claim 1 wherein said susceptor sheet stock includes a dielectric paperboard support layer and a layer of microwave interactive material affixed to one side thereof allowing passage of microwave energy while being heated thereby; said microwave interactive layer affixed to that side of said paperboard which forms the interior of said receptacle when assembled into said sleeve configuration.

3. The receptacle of claim 2 wherein an additional layer of microwave interactive material is applied to the exterior surface of said stock over one of the said sleeve portions thereof.

4. The receptacle of claim 3 wherein a microwave reflective layer is provided on one side of said sleeve over one of its said portions.

5. An open ended sleeve receptacle for receiving a frozen food article to be heated in a microwave oven and which is assembled, from a flat sheet of microwave susceptor sheet stock which defines its initial configuration, by the consumer into its assembled sleeve configuration; said sleeve receptacle comprising:

an initially flat sheet of microwave susceptor sheet stock having a rectilinear configuration defined by a pair of generally parallel longitudinally extending edges and a pair of generally parallel laterally extending edges orthogonal to said longitudinal edges and defining the open ends of said receptacle in its sleeve configuration; first and second longitudinally extending fold lines defining a base portion of said sleeve therebetween; a third longitudinally extending fold line laterally spaced between one of said longitudinal edges and said first fold line to define a first sidewall portion of said sleeve extending between said first and third fold lines and a first top portion of said sleeve extending between said third fold line and said one of said longitudinal edges; a fourth fold line laterally spaced between said second fold line and the other longitudinal edge to define a second sidewall portion of said sleeve extending between said second and fourth fold lines and a second top portion of said sleeve extending between said fourth fold line and said other one of said longitudinal edges; and attachment means associated with one of said longitudinal edges for releasably securing said first and second top portions together to form said sleeve configuration for heating said food article while permitting said first and second top portions to be separated after heating for food removal, said attachment means comprised solely of a tab fold line diagonally extending across one of the corners of one of said top portions; a first tab cut line extending from said longitudinal edge of said one top portion to said tab fold line and a second tab cut line extending from the adjacent lateral edge of said one top portion to said tab fold line to define an interlocking tab portion extending between said cut lines whereby said tab portion is bent over the other one of said top portions when the longitudinal edge of said other top portion is slipped into said cut lines and contacts said tab fold line to retain both of said top portions together.

6. The receptacle of claim 5 wherein said attachment means includes a said interlocking tab portion formed across each of the two corners of one of said top portions of said sleeve.

7. An open ended sleeve receptacle for receiving a frozen food article to be heated in a microwave oven and which is assembled, from a flat sheet of microwave susceptor sheet stock which defines its initial configuration, by the consumer into its assembled sleeve configuration; said sleeve receptacle comprising:

an initially flat sheet of microwave susceptor sheet stock having a rectilinear configuration defined by a pair of generally parallel longitudinally extending edges and a pair of generally parallel laterally extending edges orthogonal to said longitudinal edges and defining the open ends of said receptacle in its sleeve configuration; first and second longitudinally extending fold lines defining a base portion of said sleeve therebetween; a third longitudinally extending fold line laterally spaced between one of said longitudinal edges and said first fold line to define a first sidewall portion of said sleeve extending between said first and third fold lines and a first top portion of said sleeve extending between said third fold line and said one of said longitudinal edges; a fourth fold line laterally spaced between said second fold line and the other longitudinal edge to define a second sidewall portion of said sleeve extending between said second and fourth fold lines and a second top portion of said sleeve extending between said fourth fold line and said other one of said longitudinal edges; and attachment means associated with one of said longitudinal edges for releasably securing said first and second top portions together to form said sleeve configuration for heating said food article while permitting said first and second top portions to be separated after heating for food removal, said attachment means comprised solely of a tab extending laterally from said longitudinal edge of said first top portion and a slit cut in said second top portion aligned with said tab whereby said tab slips and locks into said slit when said sleeve is folded on said fold lines to releasably lock said first and second top portions together.

8. The open ended receptacle for receiving a frozen food article to be heated in a microwave oven and which is assembled from a flat sheet of susceptor stock material defining an initial configuration of said receptacle to its assembled sleeve configuration, said susceptor sheet in its initial configuration having a rectilinear configuration defined by a pair of generally parallel longitudinally extending edges and a pair of generally parallel laterally extending edges orthogonal to said longitudinal edges and defining the open ends of said receptacle in its sleeve configuration, first and second longitudinally extending fold lines defining a base portion of said stock therebetween; a third longitudinally extending fold line laterally spaced between one of said longitudinal edges and said first fold line to define a first sidewall portion of said stock and a fourth fold line laterally spaced between said second fold line and the other longitudinal edge to define a second sidewall portion of said stock; said susceptor sheet stock includes a dielectric paperboard support layer and a layer of microwave interactive material affixed to one side thereof allowing passage of microwave energy while being heated thereby, said microwave interactive layer affixed to that side of said paperboard which forms the interior of said receptacle when assembled into said sleeve configuration; said receptacle including an additional layer of interactive material applied to the exterior surface of said stock only over said base portion thereof; said receptacle including a microwave reflective layer provided on one side of said stock over the base portion for crisping and browning the surface of said food article in contact therewith; said stock cut on cut lines extending laterally at a 45° angle into said base portion from said first fold line for a discrete distance and connected by cut lines parallel to said first fold line to define two first leg portions and said stock cut on cut lines extending laterally into said base portion from said second fold line for a discrete distance and connected by cut lines parallel to said second fold line to define two second leg portions; and attachment means associated with one of said longitudinal edges for securing that portion of said stock extending from said fourth fold line to said longitudinal edge closest thereto with the portion of said stock extending from said third fold line to said longitudinal edge closest thereto when said stock is folded on said fold lines when assembling said receptacle to its sleeve configuration in which said leg portions underlie said sidewall portions and support said base portion spaced away from the floor of said oven.

9. The receptacle of claim 8 wherein said attachment means includes mechanical connector means for releasably attaching said longitudinal edges to form said receptacle.

10. The receptacle of claim 8 wherein said attachment means includes an adhesive strip along the length of one of said longitudinal edges for attachment to the other longitudinal edge to form said receptacle.

11. The receptacle of claim 8 wherein said attachment means includes laterally extending tabs extending from one of said longitudinal edges and matching slits cut in said stock between the opposite longitudinal edge and its nearest fold line, said tabs insertable into said slits to form said receptacle.

* * * * *